US008074480B2

(12) United States Patent
Huang et al.

(10) Patent No.: US 8,074,480 B2
(45) Date of Patent: Dec. 13, 2011

(54) REKEYABLE LOCK CYLINDER WITH FOOL-PROOF FUNCTION

(75) Inventors: Lien-Hsi Huang, Kaohsiung (TW); Ping-Hung Hsieh, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 500 days.

(21) Appl. No.: 12/289,482

(22) Filed: Oct. 29, 2008

(65) Prior Publication Data

US 2010/0101288 A1 Apr. 29, 2010

(51) Int. Cl.
*E05B 25/00* (2006.01)

(52) U.S. Cl. ..... 70/383; 70/492; 70/493; 70/385; 70/375; 70/337

(58) Field of Classification Search ..... 70/382–385, 70/492, 493, 379 R, 356, 375, 387, 337, 338, 70/340

See application file for complete search history.

(56) References Cited

U.S. PATENT DOCUMENTS

| | | | | | |
|---|---|---|---|---|---|
| 3,095,726 | A * | 7/1963 | Schlage | 70/383 |
| 3,172,284 | A * | 3/1965 | Crandell et al. | 70/383 |
| 3,175,379 | A * | 3/1965 | Russell et al. | 70/383 |
| 3,210,973 | A * | 10/1965 | Basseches | 70/383 |
| 3,261,189 | A * | 7/1966 | Ellison | 70/493 |
| 3,395,558 | A * | 8/1968 | Russell et al. | 70/493 |
| 3,429,154 | A * | 2/1969 | Schwartz | 70/375 |
| 3,875,773 | A * | 4/1975 | Thimot | 70/337 |
| 4,185,480 | A * | 1/1980 | Pechner | 70/358 |
| 4,836,002 | A * | 6/1989 | Monahan | 70/382 |
| 5,103,661 | A * | 4/1992 | Fann et al. | 70/360 |
| 5,718,136 | A * | 2/1998 | Aldieri et al. | 70/385 |
| 5,758,528 | A * | 6/1998 | Gallego | 70/385 |
| 6,389,859 | B1 * | 5/2002 | Paolini et al. | 70/340 |
| 6,968,717 | B2 * | 11/2005 | Suzuki et al. | 70/492 |
| 7,007,528 | B2 * | 3/2006 | Chong et al. | 70/492 |
| 7,434,431 | B2 * | 10/2008 | Armstrong et al. | 70/492 |
| 7,526,935 | B2 * | 5/2009 | Huang et al. | 70/360 |
| 7,624,606 | B1 * | 12/2009 | Huang et al. | 70/338 |
| 7,628,048 | B2 * | 12/2009 | Huang et al. | 70/338 |
| 7,836,739 | B2 * | 11/2010 | Huang et al. | 70/360 |
| 7,874,191 | B2 * | 1/2011 | Chiang et al. | 70/492 |
| 7,900,491 | B2 * | 3/2011 | Chong | 70/492 |
| 2008/0276674 | A1 * | 11/2008 | Huang et al. | 70/493 |
| 2008/0314106 | A1 * | 12/2008 | Mathachan | 70/493 |
| 2009/0277239 | A1 * | 11/2009 | Mathachan | 70/383 |

* cited by examiner

*Primary Examiner* — Suzanne Barrett
(74) *Attorney, Agent, or Firm* — Muncy, Geissler, Olds & Lowe, PLLC

(57) ABSTRACT

A rekeyable lock cylinder with fool-proof function at least comprises a cylinder body, a plug, a limit member, a sliding block and a drive member. The plug disposed within the cylinder body has a trench, a plurality of first rack component runners communicating with the trench and a first through hole also communicating with the trench. The limit member is disposed within the first through hole and the sliding block is disposed within the trench. The sliding block has a plurality of second rack component runners respectively corresponding to each of the first rack component runners, a keyhole communicating with the second rack component runners and a second through hole communicating with the keyhole. The second through hole corresponds to the first through hole of the plug. The drive member is disposed within the second through hole and one end of the limit member contacts against the drive member.

14 Claims, 11 Drawing Sheets

REKEYABLE LOCK CYLINDER WITH FOOL-PROOF FUNCTION

FIELD OF THE INVENTION

The present invention is generally relating to a lock cylinder, more particularly to a rekeyable lock cylinder with fool-proof function.

BACKGROUND OF THE INVENTION

With reference to FIG. 1, which is a flow chart illustrating rekeying steps of a known rekeyable lock cylinder, the main steps during rekeying process are to add a thrust to the first matched key for making the sliding block move and driving the first rack components to release engagement with the second rack components and to turn the second matched key (new key) for making the sliding block restore and driving the first rack components to reengage with the second rack components. However, general users often doesn't insert the second matched key (new key) into right position to turn the plug during the step of turning the second matched key, so that the new key cannot work to release locking state. Hence, it is extremely serious topic to design a structure of rekeyable lock cylinder for ensuring rekeying operation is not allowed if key is not completely inserted.

SUMMARY

A primary object of the present invention is to provide a rekeyable lock cylinder with fool-proof function comprising a cylinder body, a plug, a limit member, a sliding block, a drive member and a plurality of rack component assemblies. The cylinder body has a hollow cylinder portion and the plug disposed within the hollow cylinder portion has a trench, a plurality of first rack component runners communicating with the trench respectively and a first through hole. The limit member is disposed within the first through hole of the plug and the sliding block disposed within the trench of the plug has a plurality of second rack component runners corresponding to each of the first rack component runners respectively, a keyhole communicating with the second rack component runners and a second through hole communicating with the keyhole and corresponding to the first through hole of the plug. The drive member is disposed within the second through hole of the sliding block and one end of the limit member contacts against the drive member. Each of the rack component assemblies is disposed within the first rack component runner of the plug and the second rack component runner of the sliding block at least comprising a first rack component and a second rack component capable of engaging with the first rack component. The present invention may apply the limit member and the drive member to ensure that rekeying operation is permitted only if key is inserted into right position i.e. completely inserted, thereby carrying fool-proof function out.

DETAILED DESCRIPTION OF THE INVENTION

Figure 1:
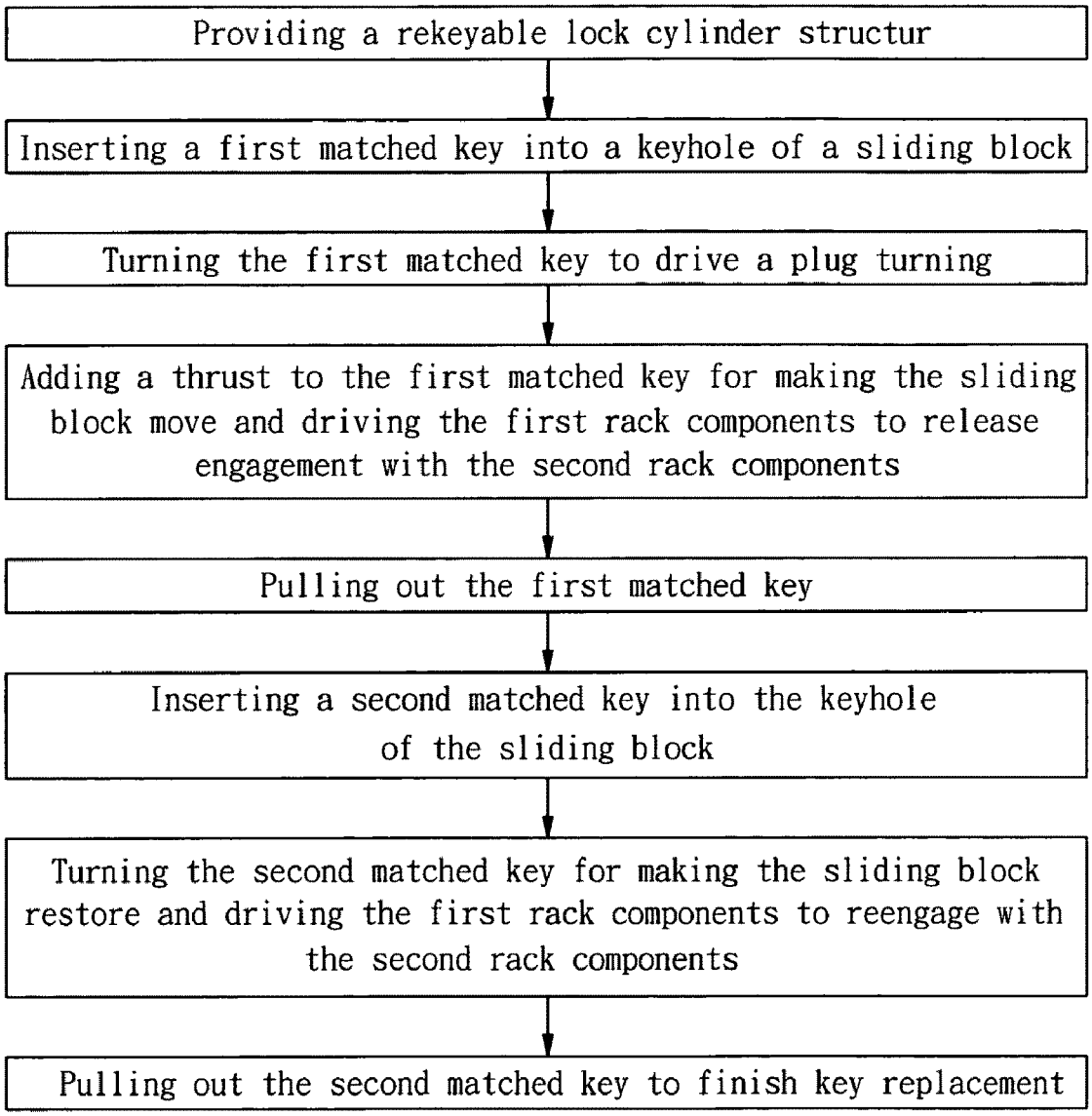
FIG. 1 PRIOR ART
FIG. 1 is a flow chart illustrating rekeying steps of a known rekeyable lock cylinder.
Figure 2:
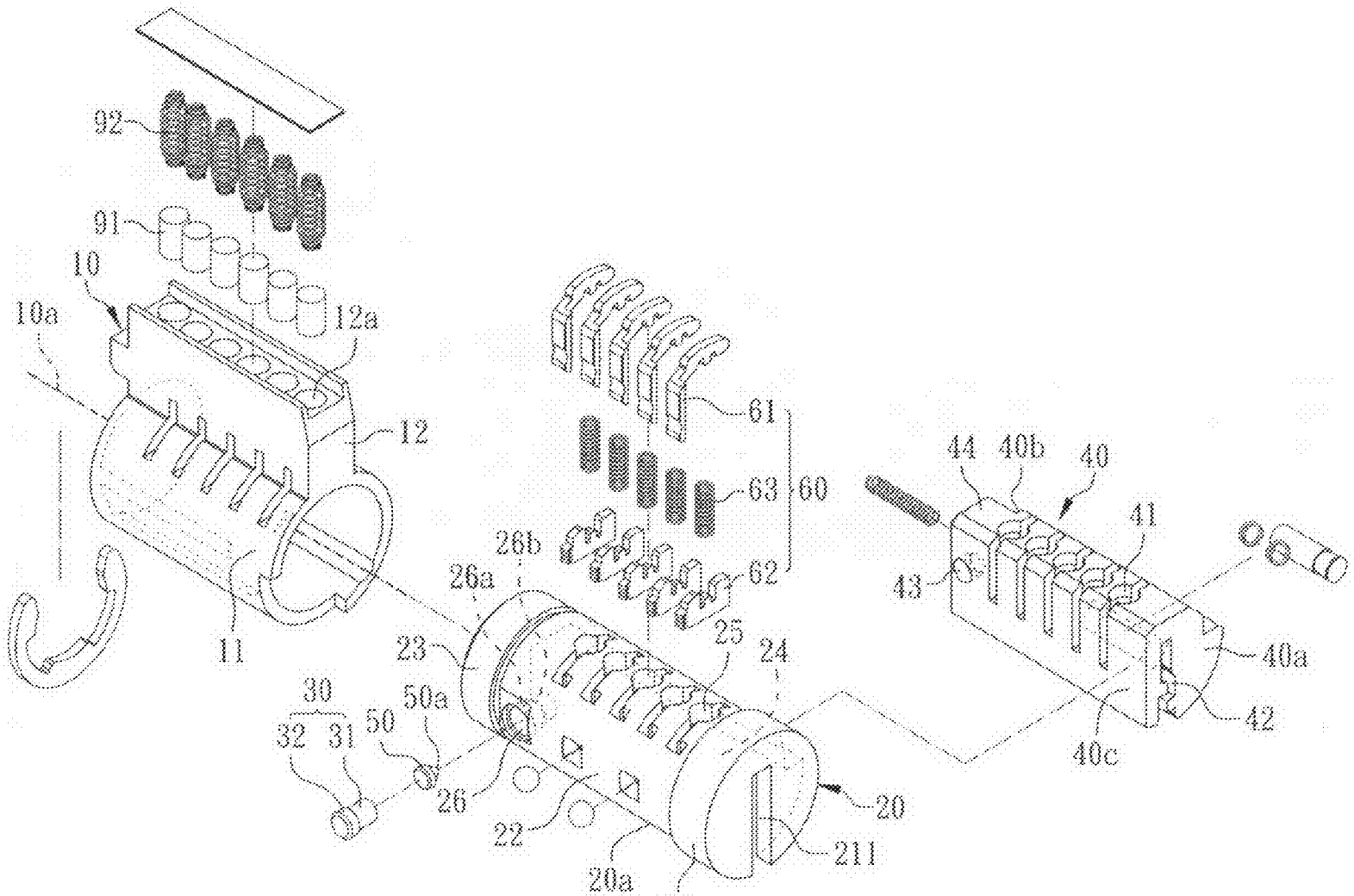
FIG. 2 is a perspective exploded view of a rekeyable lock cylinder with fool-proof function in accordance with a preferred embodiment of the present invention.
Figure 3:
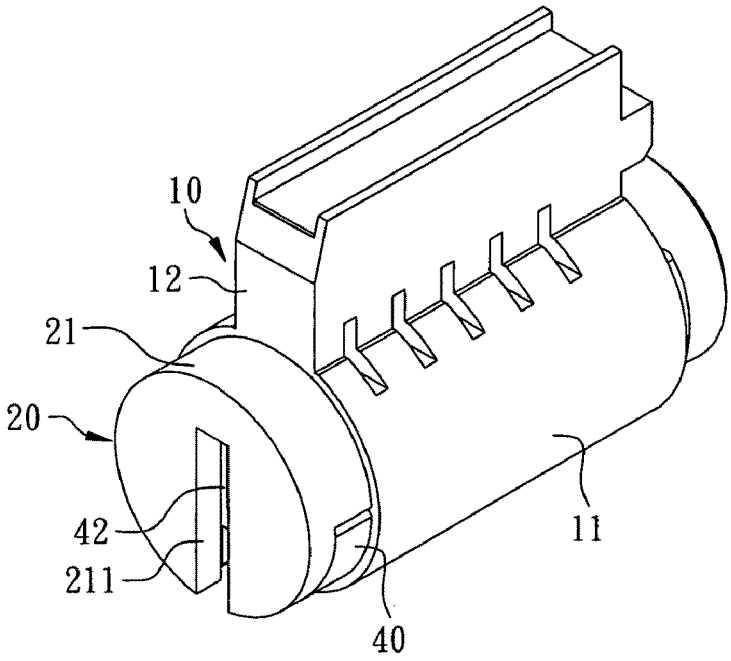
FIG. 3 is a perspective assembly view of the rekeyable lock cylinder with fool-proof function in accordance with a preferred embodiment of the present invention.
Figure 4:
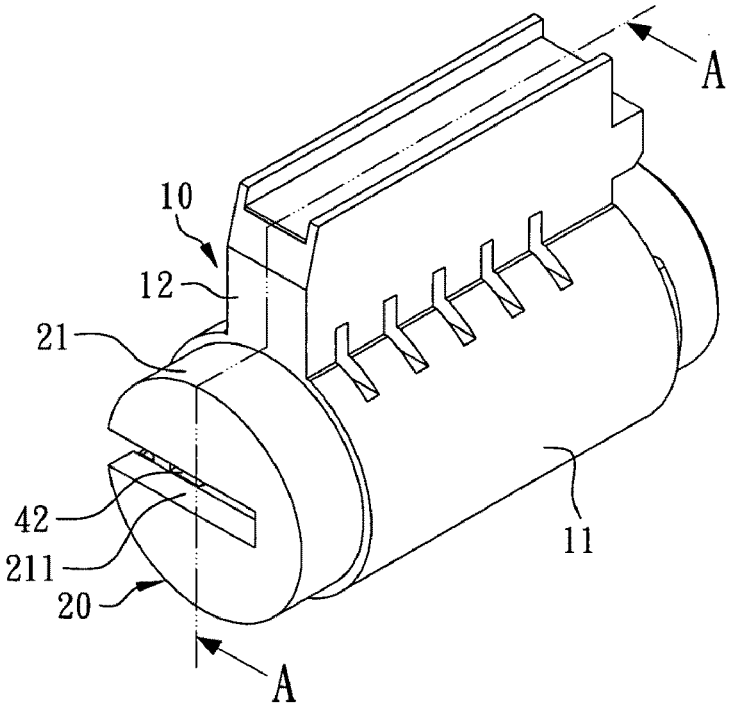
FIG. 4 is a perspective assembly view of the rekeyable lock cylinder with fool-proof function after plug is turned by a specific angle in accordance with a preferred embodiment of the present invention.
Figure 5:
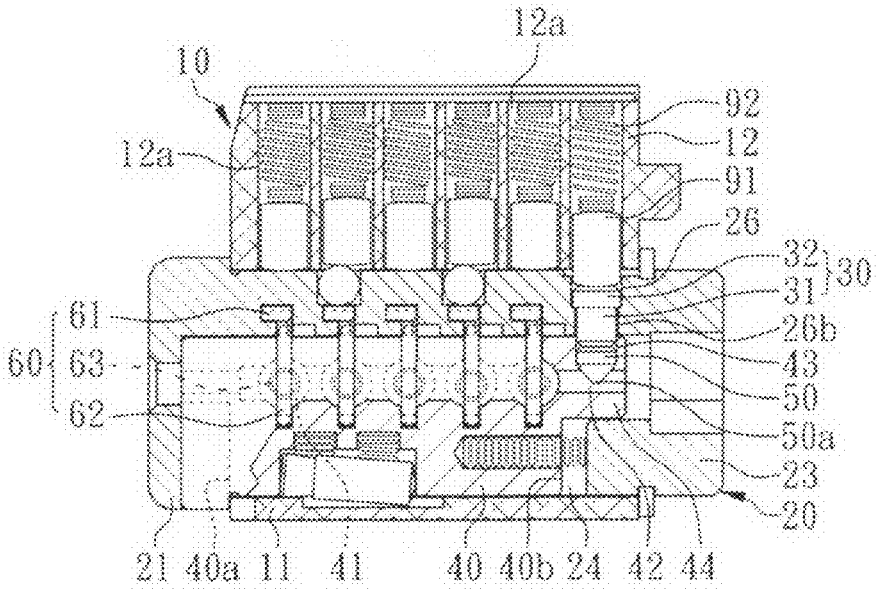
FIG. 5 is a longitudinal section view of the rekeyable lock cylinder with fool-proof function after plug is turned by a specific angle along A-A line of FIG. 4.
Figure 6:
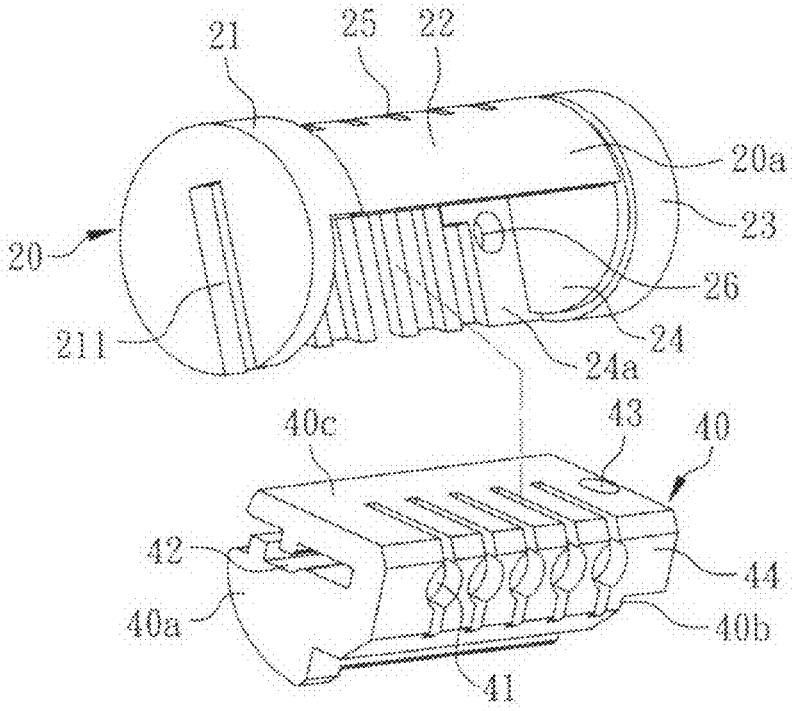
FIG. 6 is an assembly view of a sliding block and a plug in accordance with a preferred embodiment of the present invention.

FIGS. 1 and 2 illustrates a rekeyable lock cylinder with fool-proof function in accordance with a preferred embodiment of the present invention comprising a cylinder body 10, a plug 20, a limit member 30, a sliding block 40, a drive member 50 and a plurality of rack component assemblies 60. The cylinder body 10 has a hollow cylinder portion 11, an extending protrusion 12 formed at one side of the hollow cylinder portion 11 and a defined central axis 10*a*. The extending protrusion 12 has a plurality of upper pin holes 12*a* for receiving a plurality of upper pins 91 and a plurality of pin springs 92. With reference to FIGS. 2, 4, 5 and 6, the plug 20 disposed within the hollow cylinder portion 11 of the cylinder body 10 has an out side wall 20*a*, a front portion 21, an opening 211 formed at the front portion 21, a middle portion 22, a driving portion 23, a trench 24, an inner trench wall 24*a* located at the trench 24, a plurality of first rack component runners 25 communicating with the trench 24 and a first through hole 26 also communicating with the trench 24. The opening 211 communicates with the trench 24 and the first through hole 26 communicates with the out side wall 20*a* and the inner trench wall 24*a* in this embodiment. Besides, the first rack component runners 25 and the first through hole 26 are formed at the middle portion 22, the first rack component runners 25 respectively correspond to the upper pin holes 12*a* of the extending protrusion 12, and the first through hole 26 is adjacent to the driving portion 23. In addition, the first through hole 26 has a hole wall 26*a* and a flange 26*b* protruding from the hole wall 26*a* formed therein in this embodiment. With reference again to FIGS. 2, 5 and 6, the limit member 30 is disposed within the first through hole 26 of the plug 20, preferably, the limit member 30 is a T-shaped pin and has a rod 31 and a radial expanding portion 32 formed at one end of the rod 31. In this embodiment, the flange 26*b* located within the first through hole 26 can block the radial expanding portion 32 of the limit member 30. The sliding block 40 disposed within the trench 24 of the plug 20 is parallel to the central axis 10*a* of the cylinder body 10 and transversely movable having a first end surface 40*a*, a second end surface 40*b* opposite to the first end surface 40*a*, a lateral surface 40*c* facing the inner trench wall 24*a* of the plug 20, a plurality of second rack component runners 41 respectively corresponding to each of the first rack component runners 25, a keyhole 42 communicating with the second rack component runners 41 and a second through hole 43 communicating with the keyhole 42. The keyhole 42 corresponds to the opening 211 of the plug 20 and the second through hole 43 recessing from the lateral surface 40*c* corresponds to the first through hole 26 of the of the plug 20. It is desirable that the sliding block 40 has a projecting portion 44 protruding from the second end surface 40*b* and the second through hole 43 is formed at the projecting portion 44.

With reference again to FIGS. 2, 5 and 6, the drive member 50 is disposed within the second through hole 43 of the sliding block 40 and one end of the limit member 30 contacts against the drive member 50. In this embodiment, the drive member is a cone-shaped pin and has a cone portion 50*a* located at the keyhole 42 of the sliding block 40. Each of the rack component assemblies 60 disposed at the first rack component runner 25 of the plug 20 and the second rack component runner 41 of the sliding block 40 comprises a first rack component 61, a second rack component 62 capable of engaging with the first rack component 61 and a resilient member 63 disposed between the first rack component 61 and the second rack component 62. Besides, the resilient member 63 is a spring in this embodiment and the first rack component 61, the second rack component 62 and the resilient member 63 may compose a height-adjustable pin.

Figure 7A:
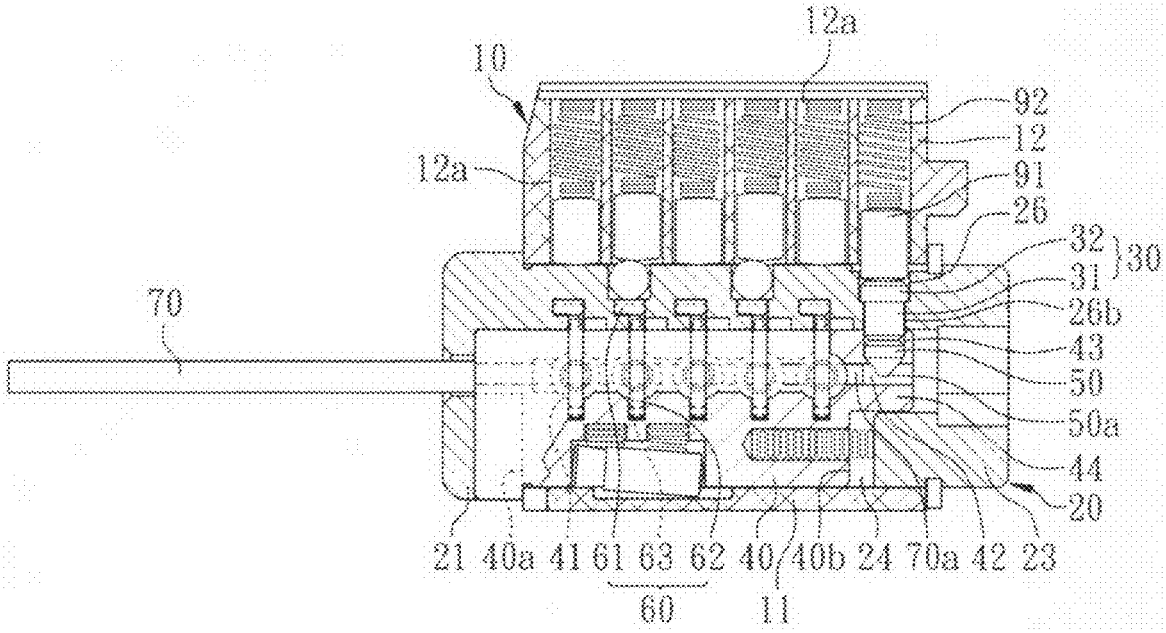
FIG. 7A is a structural view of the rekeyable lock cylinder with fool-proof function illustrating key is not inserted into right position in accordance with a preferred embodiment of the present invention.
Figure 7B:
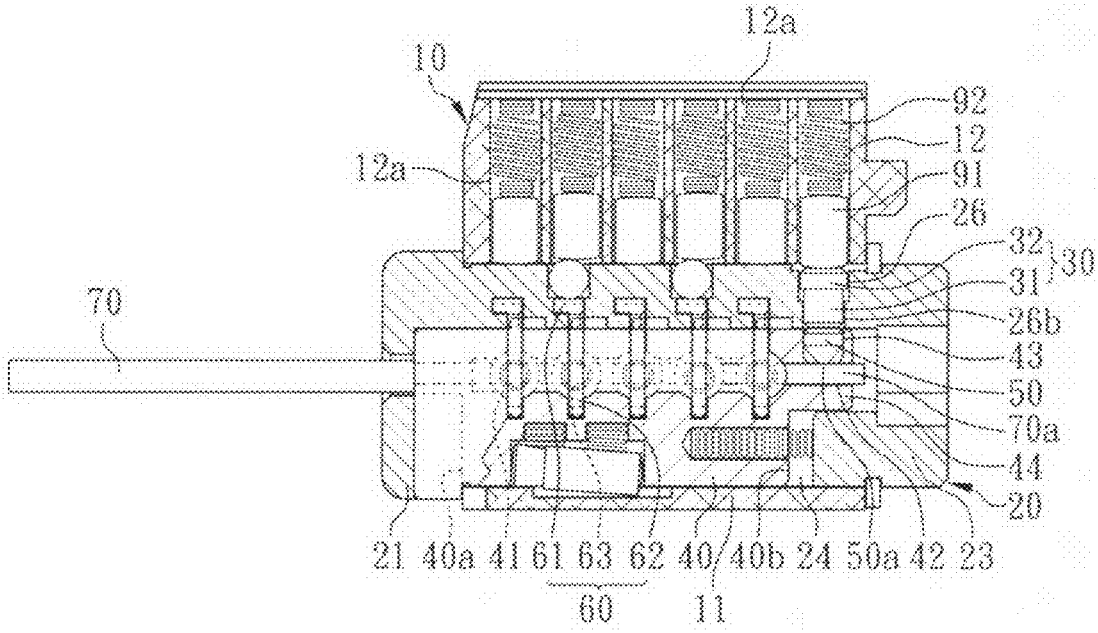
FIG. 7B is a structural view of the rekeyable lock cylinder with fool-proof function illustrating key is inserted into right position in accordance with a preferred embodiment of the present invention.
Figure 7C:
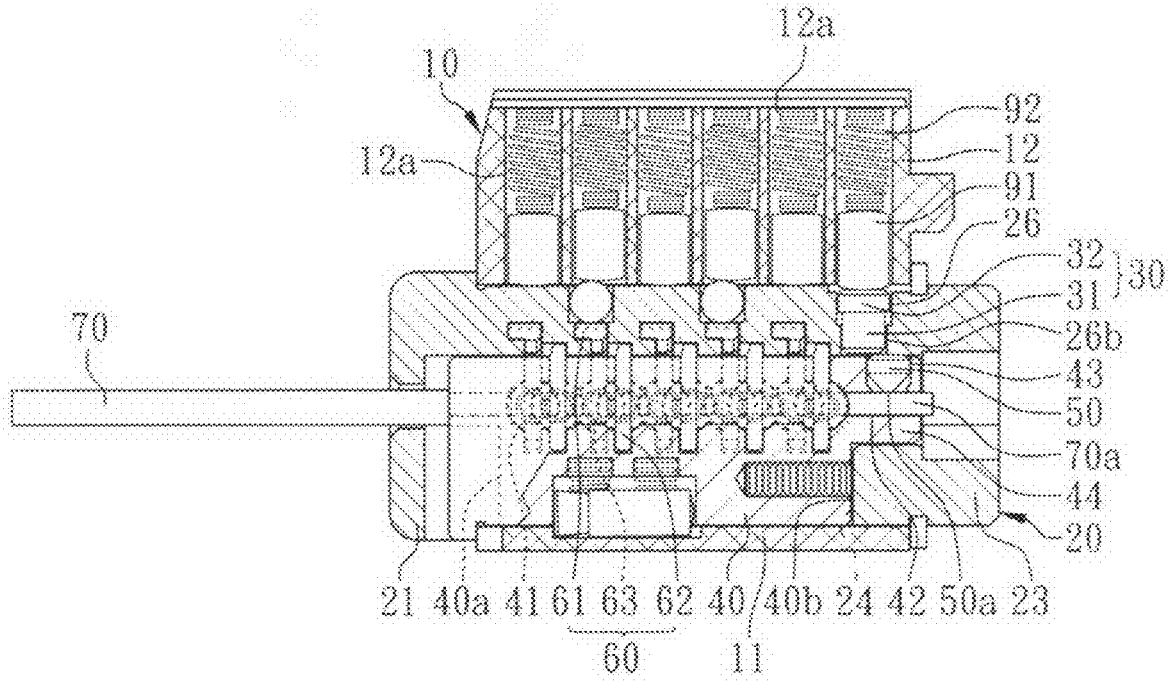
FIG. 7C is a structural view of the rekeyable lock cylinder with fool-proof function after moving sliding block and drive member in accordance with a preferred embodiment of the present invention.
Figure 8:
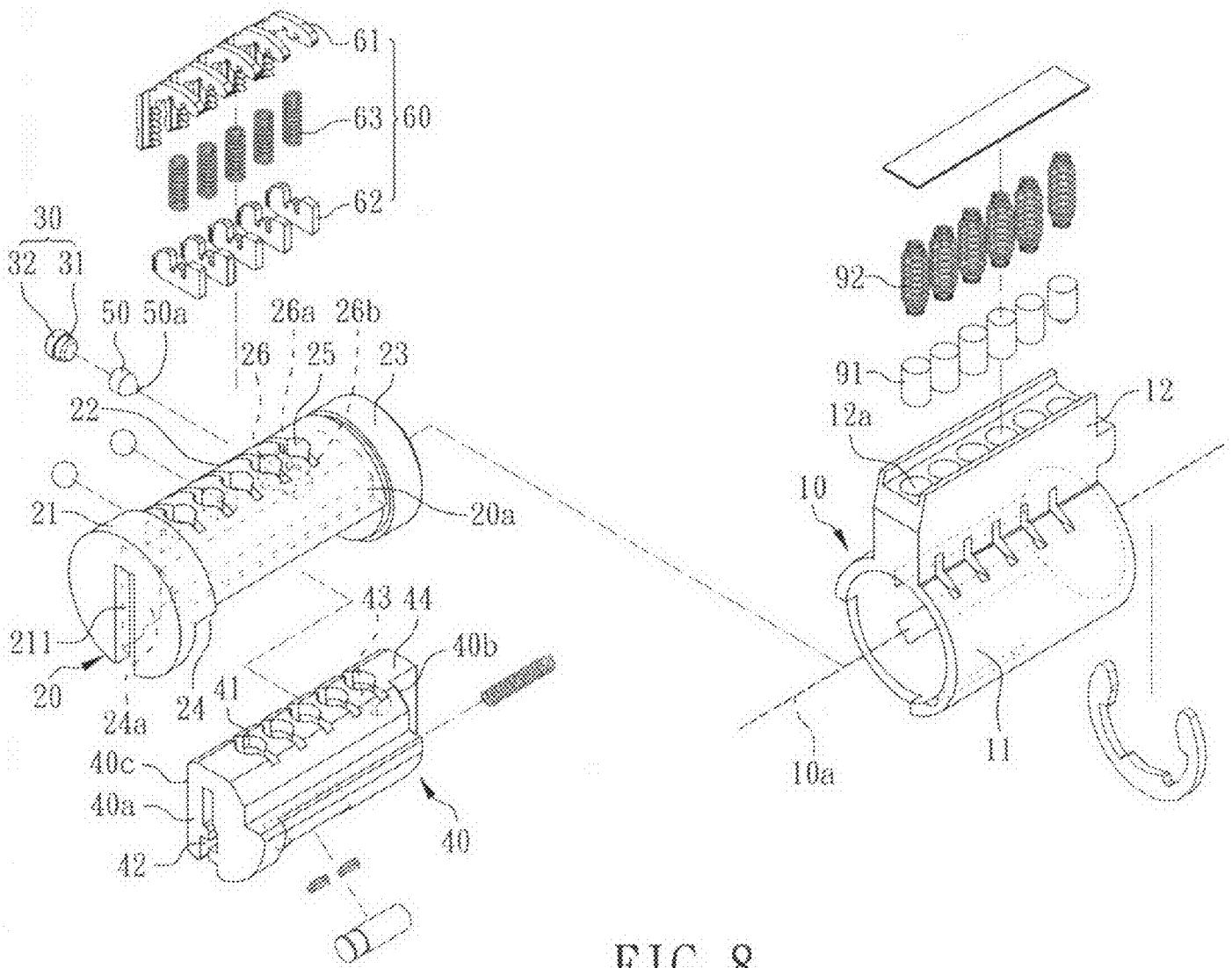
FIG. 8 is a perspective exploded view of another rekeyable lock cylinder with fool-proof function in accordance with another preferred embodiment of the present invention.
Figure 9:
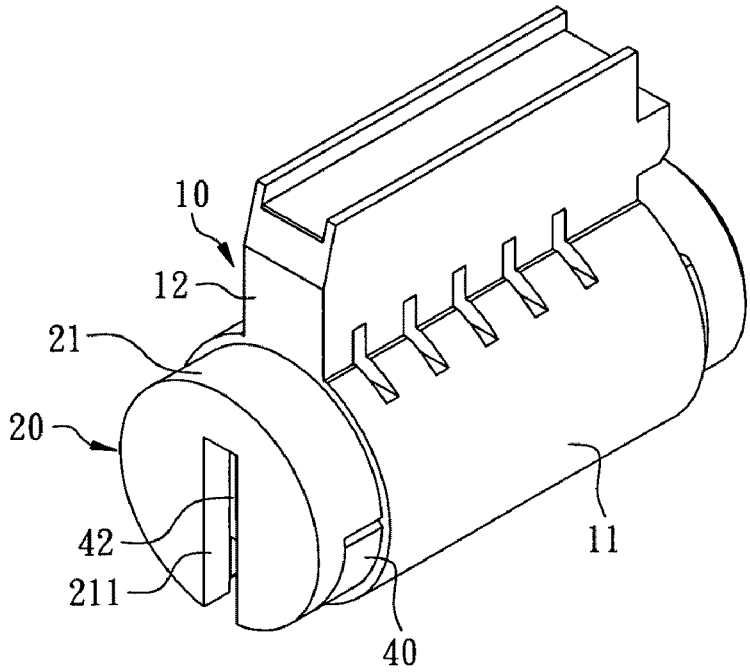
FIG. 9 is a perspective assembly view of the rekeyable lock cylinder with fool-proof function in accordance with another preferred embodiment of the present invention.
Figure 10:
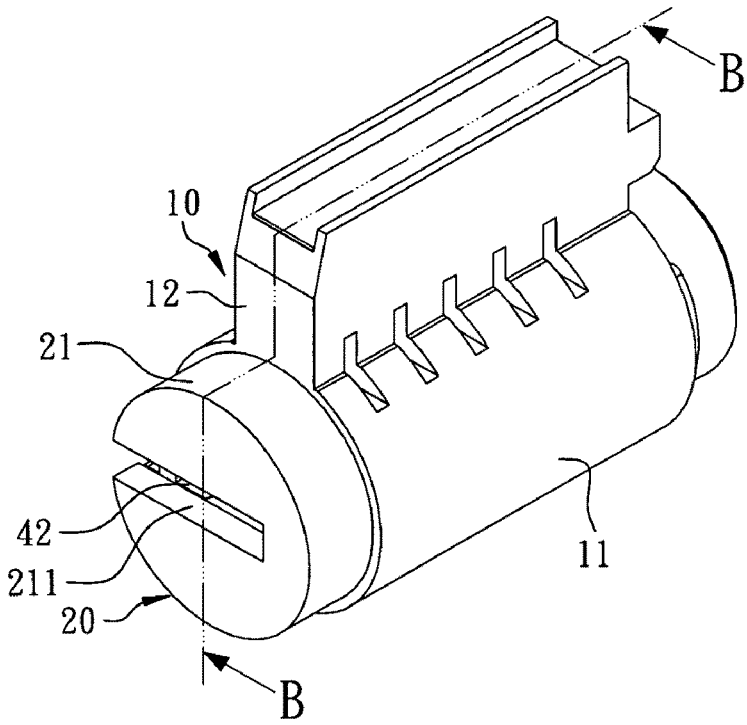
FIG. 10 is a perspective assembly view of the rekeyable lock cylinder with fool-proof function after plug is turned by a specific angle in accordance with another preferred embodiment of the present invention.
Figure 11:
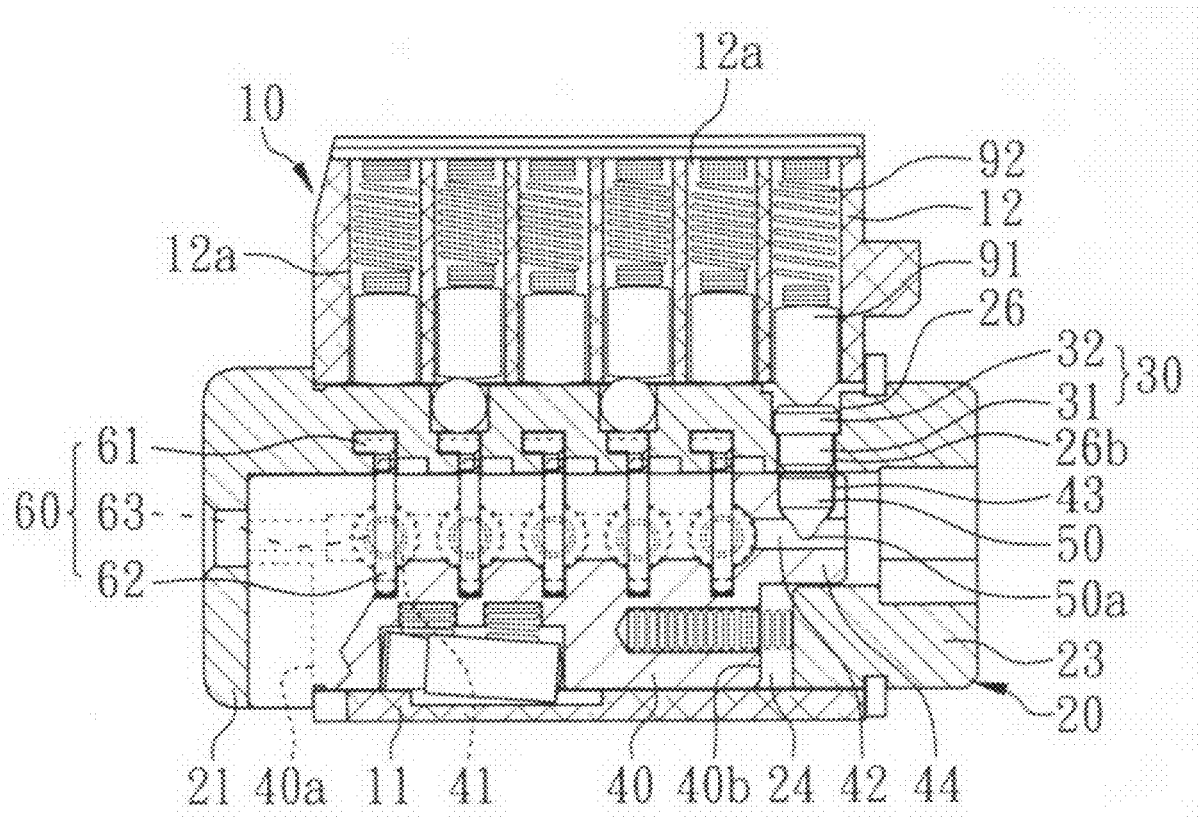
FIG. 11 is a longitudinal section view of the rekeyable lock cylinder with fool-proof function after plug is turned by a specific angle along B-B line of FIG. 10.
Figure 12A:
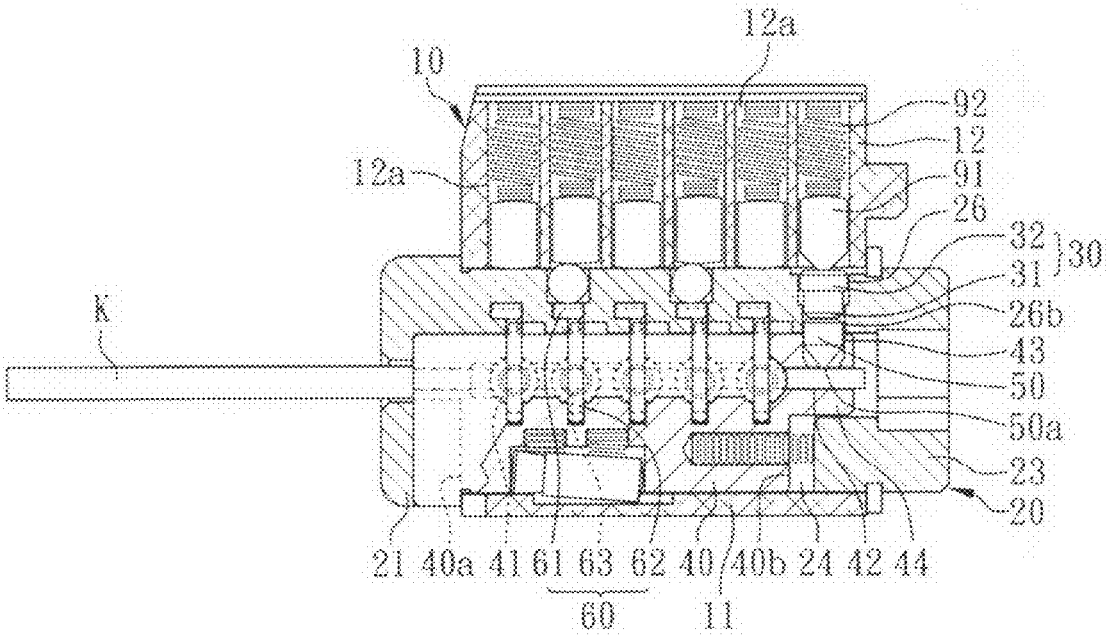
FIG. 12A is a structural view of the rekeyable lock cylinder with fool-proof function illustrating a general key is inserted into right position in accordance with another preferred embodiment of the present invention.
Figure 12B:
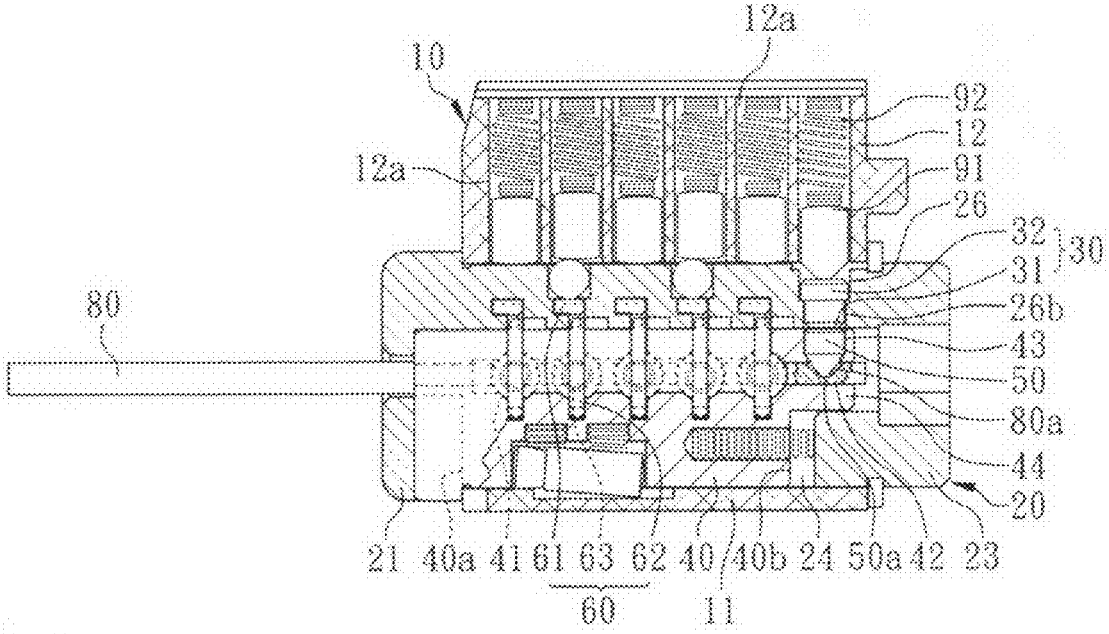
FIG. 12B is a structural view of the rekeyable lock cylinder with fool-proof function illustrating a special purpose key is inserted into right position in accordance with another preferred embodiment of the present invention.
Figure 12C:
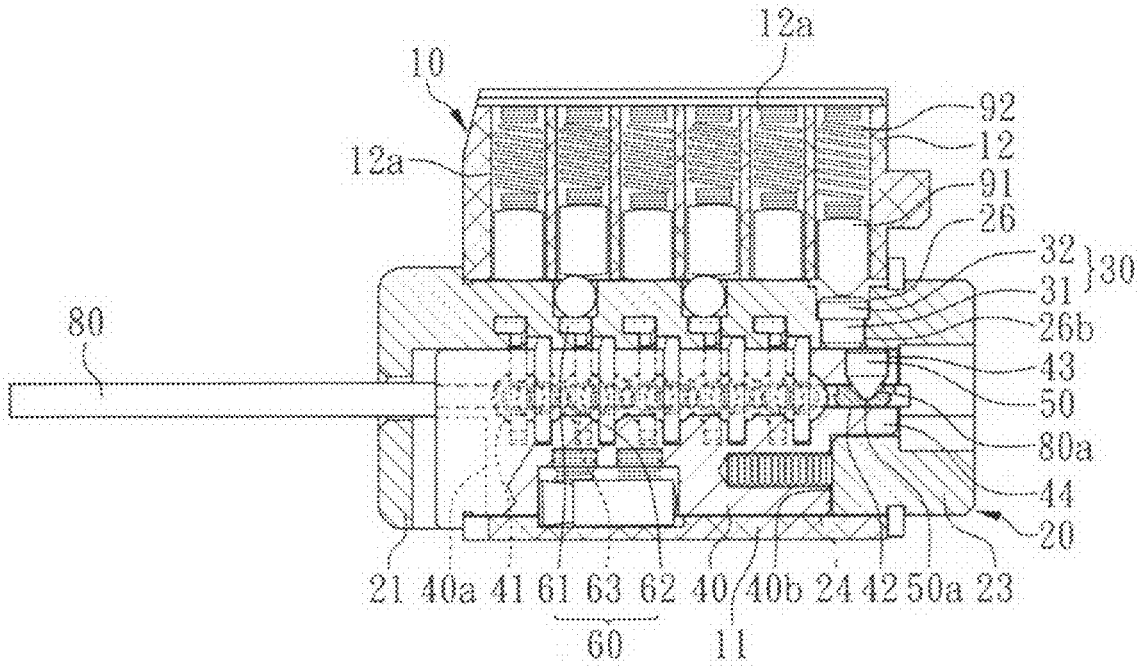
FIG. 12C is a structural view of the rekeyable lock cylinder with fool-proof function after moving sliding block and drive member in accordance with another preferred embodiment of the present invention.

FIGS. 7A-7C illustrates the rekeyable lock cylinder with fool-proof function, initially FIG. 7A shows a key 70 is inserted into the keyhole 42 but not right position yet, i.e., the key 70 is not completely inserted. Since the key 70 is not completely inserted, one terminal 70*a* of the key 70 cannot contact against the cone portion 50*a* of the drive member 50, meantime the cone portion 50*a* is pushed by the pin spring 92 to retain at the lowermost location as well as the upper pin 91 and the limit member 30 don't keep on the rotating interface, so the sliding block 40 is limited not to move as well as the plug 20 is also limited not to turn. On the contrary, with reference to FIG. 7B, when the key 70 is completely inserted, the terminal 70*a* of the key 70 will push the cone portion 50*a* of the drive member 50 to make the drive member 50 move and drive the limit member 30 and the upper pin 91 moving to the rotating interface. In addition, with reference to FIG. 7C, when adding a thrust to the key 70, limitation of the limit member 30 with respect to the sliding block 40 is released, which makes the sliding block 40 and the drive member 50 axially move. Similarly, when turning the key 70, the limitation of the upper pin 91 with respect to the plug 20 is released to allow the plug 20 to turn. Accordingly, the present invention may utilize the limit member 30 and the drive member 50 to ensure that rekeying operation is allowed only if key 70 is inserted into right position.

Furthermore, with reference to FIGS. 8, 9, 10, 11 and 12A-12C, the present invention may also be applied to a special purpose key system, wherein rekeying operation of the special purpose key system must use a special purpose key 80 with an identifying groove 80*a* to accomplish. Initially, with reference to FIGS. 8, 9, 10 and 11, heights of the limit member 30 and the drive member 50 will be adjusted by depth of the identifying groove 80*a* of the special purpose key 80, which enables the limit member 30 and the upper pin 91 to keep on the rotating interface when the drive member 50 and the cone portion 50*a* fall in the identifying groove 80*a*. Next, with reference to FIG. 12A, when a general key K is completely inserted into the keyhole 42 of the sliding block 40, since the general key K doesn't have identifying groove unable to keep the limit member 30 and the upper pin 91 on the rotating interface via the drive member 50, rekeying process cannot be carried out. On the contrary, with reference to FIG. 12B, when the special purpose key 80 is completely inserted into the keyhole 42 of the sliding block 40, the cone portion 50*a* of the drive member 50 will fall in the identifying groove 80*a* of the special purpose key 80 and meantime the limit member 30 and the upper pin 91 will move to the rotating interface. Then, with reference to FIG. 12C, when adding a thrust to the special purpose key 80, limitation of the limit member 30 with respect to the sliding block 40 is released so the sliding block 40 and the drive member 50 are axially movable. Similarly, when turning the special purpose key 80, the plug 20 can also be turned because limitation of the upper pin 91 with respect to the plug 20 has been released. Accordingly, the present invention may utilize the limit member 30 and the drive member 50 to achieve the objective that rekeying operation is allowed only if the special purpose key 80 is provided.

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. A rekeyable lock cylinder with fool-proof function comprising:

a cylinder body having a hollow cylinder portion;

a plug disposed within the hollow cylinder portion of the cylinder body having a trench, a plurality of first rack component runners communicating with the trench and a first through hole also communicating with the trench;

a limit member disposed within the first through hole of the plug;

a sliding block disposed within the trench of the plug having a plurality of second rack component runners corresponding to each of the first rack component runners respectively, a keyhole communicating with the second rack component runners and a second through hole communicating with the keyhole, the second through hole corresponding to the first through hole of the plug;

a drive member mounted within the second through hole of the sliding block, one end of the limit member contacting against the drive member; and a plurality of rack component assemblies, each of the rack component assemblies being disposed at the first rack component runner of the plug and the second rack component runner of the sliding block and at least comprising a first rack component and a second rack component capable of engaging with the first rack component.

2. The rekeyable lock cylinder with fool-proof function in accordance with claim 1, wherein the plug has an outside wall and an inner trench wall located within the trench, the first through hole communicates with the outside wall and the inner trench wall.

3. The rekeyable lock cylinder with fool-proof function in accordance with claim 2, wherein the sliding block has a lateral surface facing the inner trench wall of the plug, the second through hole recesses from the lateral surface.

4. The rekeyable lock cylinder with fool-proof function in accordance with claim 1, wherein the limit member is a T-shaped pin and has a rod and a radial expanding portion formed at one end of the rod.

5. The rekeyable lock cylinder with fool-proof function in accordance with claim 4, wherein the first through hole of the plug has a hole wall and a flange protruding from the hole wall formed therein, the flange is capable of blocking the radial expanding portion of the limit member.

6. The rekeyable lock cylinder with fool-proof function in accordance with claim 1, wherein the drive member is a cone-shaped pin and has a cone portion located at the keyhole of the sliding block.

7. The rekeyable lock cylinder with fool-proof function in accordance with claim 1, wherein the plug has a front portion, a middle portion and a driving portion, the first rack component runners and the first through hole are formed at the middle portion, the first through hole is adjacent to the driving portion.

8. The rekeyable lock cylinder with fool-proof function in accordance with claim 7, wherein the plug has an opening formed at the front portion, the opening communicates with the trench.

9. The rekeyable lock cylinder with fool-proof function in accordance with claim 8, wherein the keyhole of the sliding block corresponds with the opening of the plug.

10. The rekeyable lock cylinder with fool-proof function in accordance with claim 1, wherein the sliding block has a first end surface, a second end surface opposite to the first end surface and a projecting portion protruding from the second end surface, the second through hole is formed at the projecting portion.

11. The rekeyable lock cylinder with fool-proof function in accordance with claim 1, wherein the drive member is permanently mounted within the second through hole of the sliding block, the drive member being movable perpendicular to a longitudinal axis of the cylinder body.

12. The rekeyable lock cylinder with fool-proof function in accordance with claim 1, wherein the limit member is movable perpendicular to a longitudinal axis of the cylinder body.

13. The rekeyable lock cylinder with fool-proof function in accordance with claim 1, wherein the limit member is biasing the drive member toward the keyhole when the limit member contacts against the drive member.

14. The rekeyable lock cylinder with fool-proof function in accordance with claim 1, wherein a key inserts into the keyhole to contact the drive member to drive the limit member to a rotating interface that the plug can rotate freely in the cylinder body.

* * * * *